United States Patent [19]

Gordon et al.

[11] Patent Number: 4,770,325

[45] Date of Patent: Sep. 13, 1988

[54] POUR SPOUT FOR CONTAINERS

[75] Inventors: Robert L. Gordon, Monroe; Roderick W. Kalberer, Salisbury Mills, both of N.Y.

[73] Assignee: International Paper Company, New York, N.Y.

[21] Appl. No.: 890,229

[22] Filed: Jul. 29, 1986

[51] Int. Cl.[4] ..... B67D 3/00; B65D 5/72

[52] U.S. Cl. ..... 222/481; 222/541; 222/545; 222/571; 229/125.11; 229/125.15; 229/125.17; 229/125.42

[58] Field of Search ..... 222/571, 545, 481, 541, 222/563, ; 229/7 R, 17 R, 125.11, 125.15, 125.17, 125.42; 206/621, 626, 630

[56] References Cited

U.S. PATENT DOCUMENTS

| | | | |
|---|---|---|---|
| 1,473,453 | 11/1923 | Wunderlich . | |
| 1,862,088 | 6/1932 | Jones et al. . | |
| 2,130,676 | 9/1938 | Sebell | 221/23 |
| 2,321,042 | 7/1941 | Preis | 229/7 |
| 2,531,630 | 6/1945 | Jones | 222/528 |
| 2,657,848 | 4/1950 | Norden | 229/7 |
| 2,761,583 | 9/1956 | Morse | 220/53 |
| 2,974,824 | 3/1961 | Mansho | 220/53 |
| 3,302,818 | 2/1967 | Balocca et al. | 220/53 |
| 3,312,368 | 4/1967 | Reynolds et al. | 220/53 |
| 3,313,446 | 5/1964 | Harvey | 220/54 |
| 3,434,622 | 3/1969 | Czegledy | 220/54 |
| 3,795,359 | 3/1974 | Rausing | 229/17 R X |
| 3,927,793 | 12/1975 | Langen | 220/266 |
| 4,126,263 | 11/1978 | Martensson | 229/17 R |
| 4,135,637 | 1/1979 | Hannula | 220/271 |
| 4,223,789 | 9/1980 | Reil | 229/125.15 X |
| 4,258,876 | 3/1981 | Ljungcrantz | 206/626 X |

*Primary Examiner*—Joseph J. Rolla
*Assistant Examiner*—Gregory L. Huson
*Attorney, Agent, or Firm*—Walt Thomas Zielinski

[57] ABSTRACT

A pour spout fitment for a flat top or a gable top paperboard container. A flat strip of rigid plastic material is bent over upon itself to form upper and lower strips integrally hinged together. The lower strip carries a plug coplanar with it, the upper surface of the plug adhered to a part of the lower surface of the upper, hinged strip. The lower surface of the plug is sealed to a portion of a barrier extrusion which covers the entire interior surface of the container, the plug being aligned with a dispensing opening through the paperboard, the opening also covered by the barrier extrusion material. For initial opening and dispensing of the container contents, the upper strip is pulled upwardly, carrying with it the plug and the ruptured barrier extrusion material adhered to the plug. The surfaces of the lower strip over which the contents of the container flow during dispensing are thus protected from contamination at all times except during dispensing. In other embodiments, the upper strip is adhered to a second plug, similar to the first, and a vent hole is defined upon initial opening. In still another modification, the forward edge of the fitment extends beyond the carton edge to prevent dripping. A tamper evident tab may be provided on any embodiment, the tab being integral with the upper strip. The tab must pulled up and a seal broken between it and an associated carton wall to permit opening of the carton.

12 Claims, 2 Drawing Sheets

POUR SPOUT FOR CONTAINERS

BACKGROUND OF THE INVENTION

This invention relates to the art of paperboard containers and more particularly to a frangible seal pour spout for liquid packages. At the present time, two types of conventional containers are used for the packaging of milk, juices and juice drinks, one being square with a gable top or a flat top and the other is rectangular in shape with a gable or flat top. Each of these configurations require easy access to the product that is consumer convenient. This is especially true because of today's asceptic and hot fill technology which requires heremetic sealing of the packages. The ideal spout should have a low profile to allow for package shipping and stacking and be low in cost. All spouts should be compatible with flat top and/or gable top containers.

SUMMARY OF THE INVENTION

According to the practice this invention, a relatively rigid pour fitment is provided for either a flat top or a gable top container, such containers usually being fashioned from paperboard or the like. The fitment is formed from a relatively rigid plastic material such as high density polyethylene and is in the general form of a die cut strip. The strip is hinged to define two sections, an upper section and a lower section. The lower section is apertured, the aperture being aligned with a complementary aperture in a wall of the container. The container aperture is covered with an extruded barrier layer, the barrier layer usually covering the entire interior and often the exterior surface of the container walls. The upper, hinged fitment section is adhered to a removable plug in the aperture of the lower section of the fitment. Upon lifting up the upper section, the plug ruptures the barrier layer material, with the now ruptured barrier layer material and the removed plug moving upwardly to thereby define a pour opening to permit dispensing of the contents of the container. The plug serves as a guide to facilitate a snap reclosure of the upper section of the fitment into the lower portion of the fitment.

By virture of the surface-to-surface contact between the upper and lower fitment sections in the closed or normal fitment configuration, the upper surface of the lower fitment section, over which the container contents flow when dispensed, is protected from contamination at all times except when actual pouring or dispensing occurs.

The upper section of the fitment can carry a flap which normally is sealed to a side wall of the container to yield tamper evidence upon initial opening.

In a modification, the fitment carriers an extended overhanding lip at its lower section to inhibit dripping by breaking the surface tension of the liquid being poured.

In yet another modification of the invention, a second aperture may be added to function as a vent opening. In still another modification, the ends of the upper fitment section are hinged with respect to its middle portion, with each hinged portion carrying its own plug, to thereby define a vented pour fitment.

DETAILED DESCRIPTION OF THE INVENTION

Figure 1:
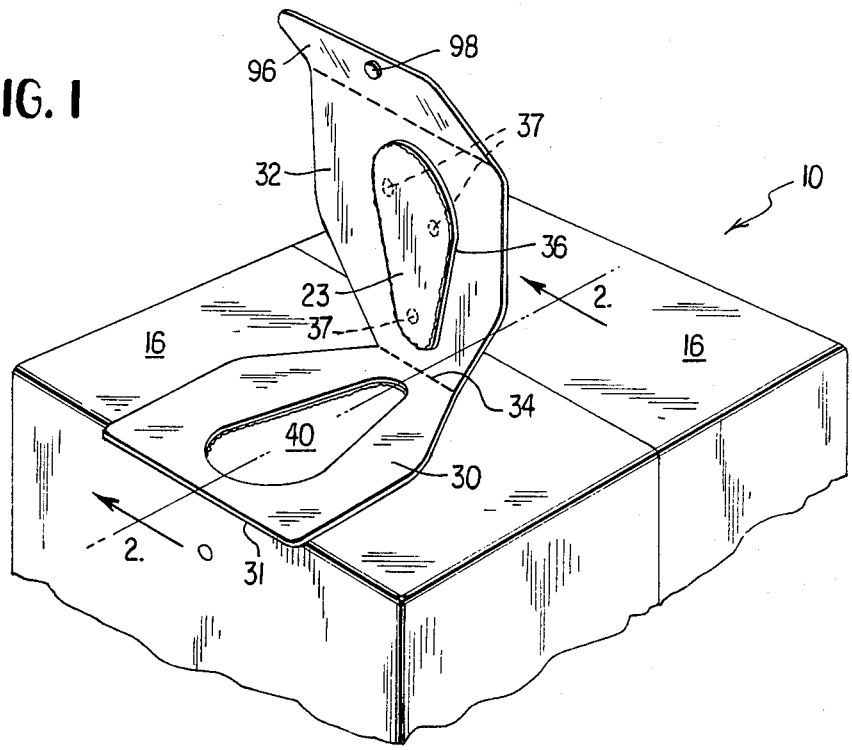
FIG. 1 is a partial perspective view of the upper portion of a flat top container provided with the relatively rigid pour spout opening fitment of this invention.
Figure 2:
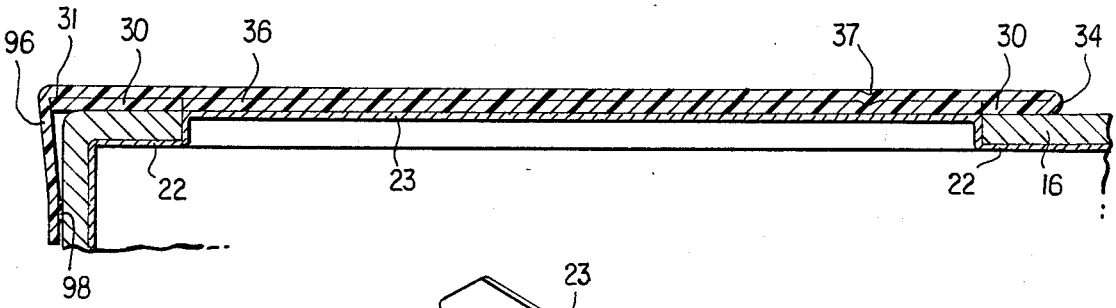
FIG. 2 is a sectional view taken along section 2—2 of FIG. 1, in the fitment closed configuration.

Referring now to FIGS. 1 and 2, the numeral 10 denotes a flat top package, fashioned from paperboard, the container having an upper end wall 16, the container being extrusion coated with a barrier layer 22 on its interior surfaces. A similar barrier layer may also be carried on the exterior surface of the container. The numeral 23 denotes that portion of barrier layer 22 which is secured, using conventional sealing methods or an adhesive, to a plug member shortly to be described. The numeral 30 denotes the lower section of the hinged strip pour fitment of this invention, the fitment formed of a rigid plastics material, such as high density polyethelene. Section 30 is of generally rectangular shape and is integrally hinged to an upper and similarly shaped section 32. Portions 30 and 32 are hinged at axis 34. Sections 30 and 32 may be considered as, respectively, lower and upper flaps, of a bent or hinged polyethylene strip. The numeral 36 denotes a plug, die cut from lower portion 30, and attached by three sealing welds 37 at its upper surface to the underside of upper strip or layer member 32. The numeral 96 denotes a hinged tab at the forward end of flap 32. This tab hinges over forward edge 31 of section 30 and is sealed to a wall of the container by a weldment seal 98. When broken, the weldment seal is an indication of prior opening, thus functioning to evidence tampering.

In operation, commencing with the configuration shown at FIG. 2, the user pulls up on tab 96. By virtue of the sealing between the lower surface of flap 32 and the upper surface of the plug, flap 32 carries with it plug 36 and also the torn off or ripped portion 23 of the barrier layer extrusion 22 which is sealed to the plug. The die cutting of strip 30, to define plug 36, is carried out by cutting completely through the thickness of strip 30, except at a plurality of angularly spaced portions wherein a small portion of the plastics material remains intact. The die cutting defines very nearly all of the circumference of plug 36, with only enough left to hold it in place prior to the opening procedure in passing from FIG. 2 to FIG. 1.

If less than the entire contents of carton 10 have been dispensed, the user may reclose the container by pushing the flap 32 down (counter-clockwise as seen at FIG. 1) to thereby reinsert plug 36 into its original position, namely, in the same plane as strip or flap 30 from which it is formed. The reader will observe that one advantage of the three-dimensional or double layer closure and pour fitment of this invention is that a positive and reliable reclosure is realized. Further, in pouring out the liquid contents from the container, some of the liquid or other contents poured out will come in contact with the peripheral portion (which surrounds the pour opening 40) of lower flap 30. With the construction of FIGS. 1 and 2, however, that potion of lower fitment strip 30 which surrounds the dispensing opening 40 is normally covered by complementary portions of upper fitment strip or flap 32. Thus, there can be no contamination of the upper surface of flap 30 which surrounds pour or dispensing opening 40 prior to the initial opening and dispensing of the carton.

The manufacture of a carton shown at FIGS. 1 and 2 may be carried out as follows. Initially, the paperboard, the pour opening 40 and barrier extrusion layer 22 are formed by a manufacturer, and thereafter shipped out to a packager. At the place of forming and filling the package, the relatively rigid fitment 30, 32, initially is an open or flat condition, is applied by sealing the bottom of portion 30 on the container around the perimeter of opening 40. Thus, the bottom of plug 36 is initially secured, as by sealing or adhesive, to the upper portion of extrusion layer 22 (denoted by the numeral 23). The seal between plug 36 and flap 32 must be stronger than the force needed to tear or rupture extrusion layer 22. The three sealing weldments 37 provide this tensile strength. The sealing pressure distorts opening 40, radially inwardly slightly, thereby creating an interference fit between the periphery of plug 36 and the edge of opening 40. Thus a snap reclosure is achieved. Thereafter, the flap 32 is hinged toward strip 30 so as to lie flat thereagainst, and is secured by heat or adhesive or a combination of them to the upper surface of plug 36. The flap 96 is folded over the edge 31 and sealed to the side of the carton for tamper evidence.

Figure 3:
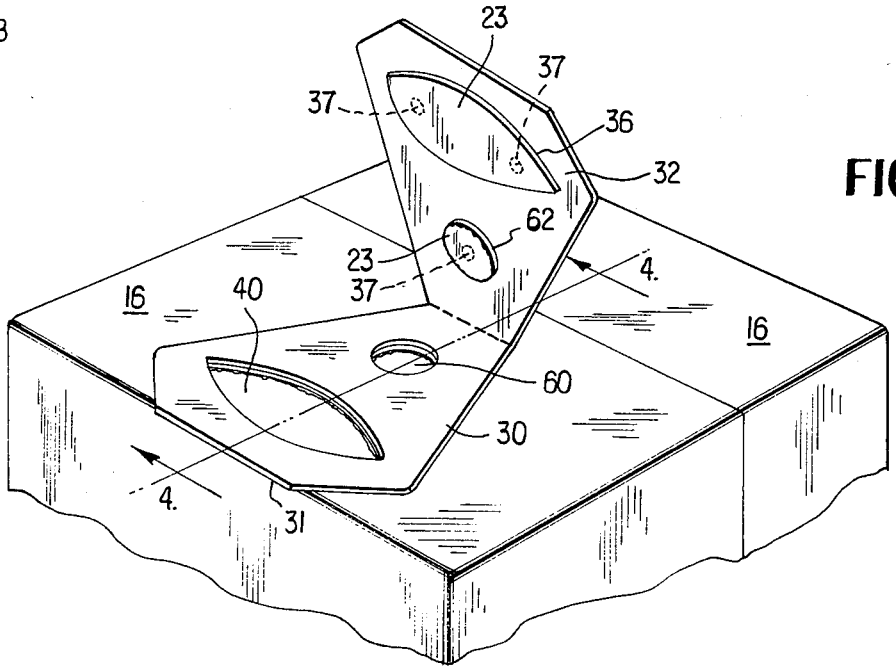
FIG. 3 is a view similar to FIG. 1 and illustrates a modified pour fitment having a vent opening.
Figure 4:
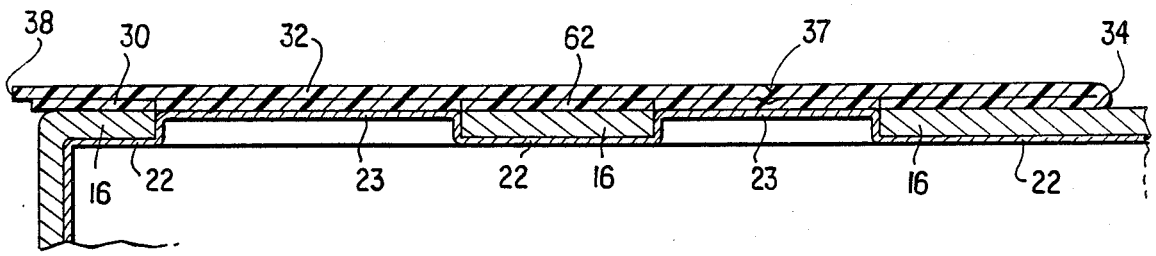
FIG. 4 is a sectional view taken along section 4—4 of FIG. 3, in the fitment closed configuration.

Turning now to FIGS. 3 and 4, another embodiment is illustrated of a relatively rigid three-dimensional or double layer fitment. Essentially, this embodiment differs from that previously described in the inclusion of a second or venting aperture to facilitate pouring out of the container liquid contents. By the provision of a vent hole, the dispensing opening 40 may be made smaller. The numeral 30 again denotes a lower strip of the three-dimensional plastics fitment and is joined to a complementary upper strip 32 by means of a hinge axis 34. As with the embodiment of FIGS. 1 and 2, the upper and lower layers of the fitment are thus integral. Forward edge 31 of lower strip 30 overhangs the associated container wall, similar to that of FIG. 2. The numeral 36 again denotes a plug, similar to that of FIG. 1, secured by adhesive, heat or pressure or a combination of them to the bottom surface of upper flap 32, with numeral 23 again denoting the torn off portion of the barrier layer material 22. A venting opening 60, similar to dispensing, main opening 40, is formed in the wall 16. A second plug, denoted as 62, is die cut from strip 30, and is otherwise similar to plug 36 in its manner of formation. FIG. 4 shows the carton configuration prior to the initial opening. To effect opening, to reach the pouring or dispensing position shown at FIG. 3, the forward edge portion 38 of flap 32 is lifted, thereby carrying upwardly plugs 36 and 62 from their original position in the plane of strip 30. Again, barrier layer 22 is ruptured carrying portions 23 thereof with the plugs, as may be seen at FIG. 3. The fitment shown at FIGS. 3 and 4 thus exhibits both a pour opening 40 and a vent opening 60.

Figure 5:
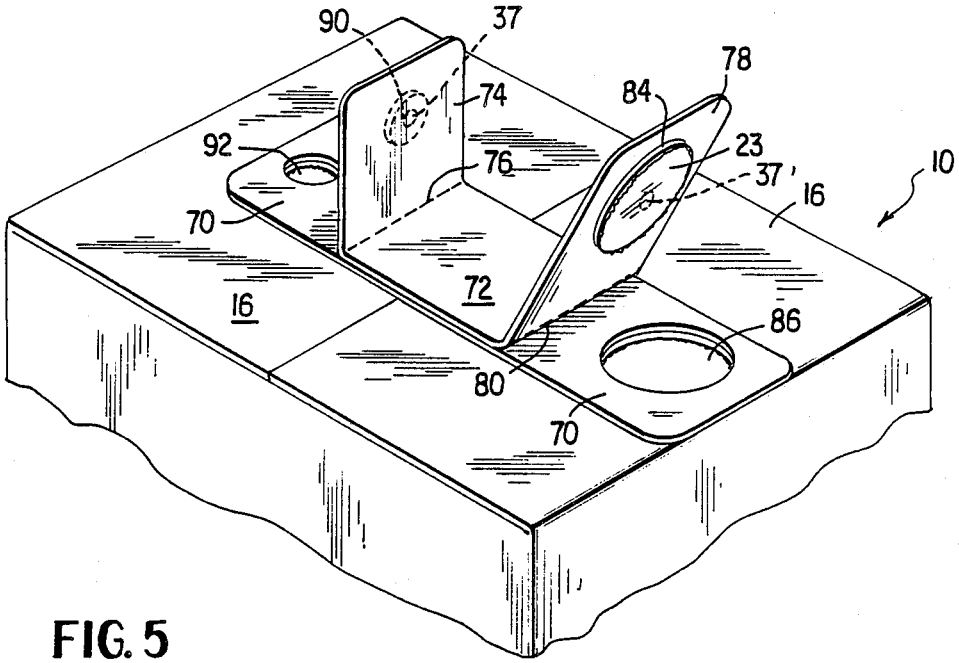
FIG. 5 is a view similar to FIG. 3 and shows another embodiment of a vented pour fitment according to the practice of this invention.

Referring now to FIG. 5, yet another relatively rigid three-dimensional or double layer embodiment is illustrated, being somewhat similar to the embodiment shown at FIG. 1. The fitment is applied to a container 10 having a barrier layer 22 therein, as before.

The numeral 70 denotes a lower rigid plastics polyethlene, as with the previously described embodiments. Upper strip 72 carries a hinged flap 74, the latter defined by a hinge axis 76. Strip 72 carries another flap 78 defined by hinge axis 80. The right hand portion of strip 72 is secured, as by an integral hinge axis or bend 71 to lower strip 70. The central portion of strip 72 is secured as by adhesive to the central portion of lower strip 70. Flap 78 carries a plug 84 and flap 74 carries a plug 90. Plugs 84 and 90 are die cut from strip 70, entirely similar to plug 36 die cut from strip 30 of FIG. 1 and to plugs 36 and 62 die cut from strip 30 of FIG. 3. The lower surface of each plug 84, 90 is sealed to portions 23 of interior barrier layer 22. In operation, with flaps 74 and 78 initially in the same plane as upper strip 70, the flaps are lifted upwardly to the position shown at FIG. 5. With such lifting, plug 84 of flap 78 and plug 90, shown in dashed lines, attached to the underside of flap 74, are both pulled upwardly from lower strip 70. The lower portions of these plugs, again, carry with them the ruptured barrier layer portions 23. Openings 86 and 92 function, respectively, as pour and vent openings. The central portion 72 of the upper strip is an intermediate rigid strip, lying in top of lower strip 70.

Figure 6:
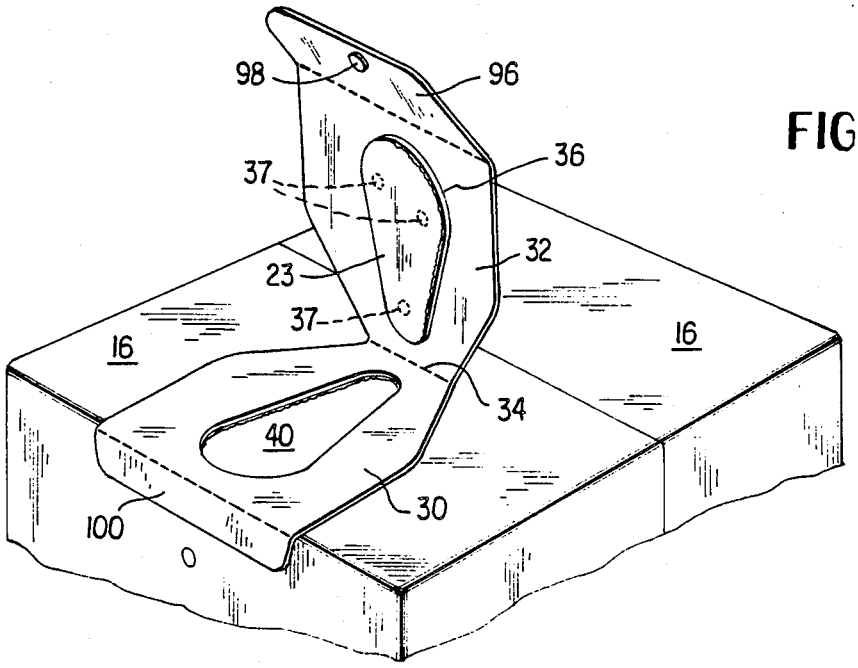
FIG. 6 is a partial perspective view, similar to FIG. 1, and shows an extended lip to inhibit dripping.

Referring now to FIG. 6, this embodiment is substantially the same as that of FIG. 1, except that a pour spout or pour flap 100 is integrally and foldably carried by the forward edge of lower fitment strip 30. Pour flap 100 performs the same function as edge 31 of the embodiment of FIG. 1, namely, to inhibit dripping by breaking surface tension of the liquid poured over it. In other respects, the embodiment of FIG. 6 is identical to that of FIG. 1.

While the fitments have been illustrated as applied to flat top containers, they may also may be used with gable top containers by placing them as for example on one of the sloping roof panels. They yield a superior opening, pouring and releasability with respect to conventional pour spouts.

We claim:

1. A frangible seal construction for a container formed from paperboard and adapted to carry a liquid therein, the container having a flat wall portion and a pouring aperture extending therethrough, a rupturable barrier layer seal on the carton interior surfaces and covering the aperture, a rigid lower flap strip having a hinged upper flap, the upper flap lying on top of the lower rigid strip, the rigid lower flap strip being secured to and on top of the exterior surface of the container at said flat wall portion and overlying said aperture, said lower rigid strip having a removable plug formed from it, the plug being of a size complementary to and overlying said aperture, the upper surface of the plug secured to the lower surface of said upper hinged flap, the lower surface of the plug secured to that portion of the rupturable barrier layer seal which covers said opening, whereby when the upper hinged flap is pulled upwardly, it carries therewith the plug in parallel relationship thereto and the barrier layer seal is broken to thereby uncover the pouring aperture and the contents of the container can be dispensed through the pour aperture and whereby the plug can be pushed back to its original in said lower flap strip.

2. The seal construction of claim 1 wherein the upper hinged flap is integrally secured to the lower rigid strip.

3. The seal construction of claim 1 wherein the forward edge of the lower rigid strip extends beyond an associated container side wall to thereby inhibit dripping.

4. The seal construction of claim 1 wherein the lower rigid strip extends beyond an associated container side wall and parallel thereto, to thereby form a downwardly extending pour flap, to thereby inhibit dripping.

5. The seal construction of claim 1 wherein the forward end of the upper rigid strip carries a hinged tab, the tab extending over the forward end of the lower rigid strip and is normally secured to an associated container wall by a seal, whereby the seal must be broken to permit opening of the container.

6. The seal construction of claim 1 wherein said plug effects a snap reclosure by virtue of an interference fit between the periphery of said plug and the edge of said opening.

7. The frangible seal construction of claim 1 including a second aperture extending through the flat wall portion, the second aperture being a venting aperture, the barrier layer seal also normally covering the venting aperture, the upper hinged flap also overlying the venting aperture, the venting aperture having a removable plug formed from the lower rigid strip, the plug being of a size complimentary to and overlying the venting aperture, the lower surface of the second mentioned plug secured to the rupturable barrier layer, the upper surface of the second mentioned plug secured to the upper hinged flap.

8. The seal construction of claim 7 wherein the upper hinged flap is integrally secured to the lower rigid strip.

9. The seal construction of claim 1 wherein the upper hinged flap is integrally secured to an intermediate rigid strip, the latter positioned on top of the first mentioned, lower rigid strip.

10. The seal of claim 9 including a second upper hinged flap secured to the intermediate rigid strip, the second hinged flap overlying a respective venting aperture in said flat wall portion and secured to a second removable plug in the first mentioned, lower rigid strip, said second plug overlying the venting aperture, the interior barrier layer seal secured to the bottom of said second removable plug.

11. The seal construction of claim 1 wherein said upper flap is rigid.

12. The seal construction of claim 11 wherein said lower and upper flaps are formed from a single strip of a plastic material.

* * * * *